US007300490B2

(12) United States Patent
Ozaki et al.

(10) Patent No.: US 7,300,490 B2
(45) Date of Patent: Nov. 27, 2007

(54) IRON-BASED MIXED POWDER FOR POWDER METALLURGY AND SINTERED BODY

(75) Inventors: Yukiko Ozaki, Chiba (JP); Hiroshi Sugihara, Chiba (JP); Satoshi Uenosono, Chiba (JP)

(73) Assignee: JFE Steel Corporation, Tokyo (JP)

( * ) Notice: Subject to any disclaimer, the term of this patent is extended or adjusted under 35 U.S.C. 154(b) by 53 days.

(21) Appl. No.: 11/230,714

(22) Filed: Sep. 20, 2005

(65) Prior Publication Data

US 2006/0065072 A1 Mar. 30, 2006

(30) Foreign Application Priority Data

Sep. 27, 2004 (JP) ..... 2004-279335

(51) Int. Cl.
*B22F 1/00* (2006.01)

(52) U.S. Cl. ..... 75/252

(58) Field of Classification Search ..... 75/231, 75/252

See application file for complete search history.

(56) References Cited

U.S. PATENT DOCUMENTS

| | | | | |
|---|---|---|---|---|
| 3,297,571 | A * | 1/1967 | Bonis | 75/230 |
| 4,256,489 | A * | 3/1981 | Van Wyk | 75/231 |
| 6,139,599 | A | 10/2000 | Takahashi et al. | |
| 6,679,932 | B2 * | 1/2004 | Birler et al. | 75/231 |
| 6,802,883 | B2 * | 10/2004 | Henmi et al. | 75/240 |
| 2003/0075016 | A1 * | 4/2003 | Uenosono et al. | 75/246 |
| 2003/0219617 | A1 * | 11/2003 | Ozaki et al. | 428/570 |

FOREIGN PATENT DOCUMENTS

| | | | |
|---|---|---|---|
| EP | 0848072 | A1 | 6/1998 |
| EP | 1258537 | A2 | 11/2002 |
| EP | 1258537 | A3 | 11/2002 |
| GB | 2396624 | A | 6/2004 |
| JP | 61-147801 | A | 7/1986 |
| JP | 9-279204 | A | 10/1997 |
| JP | 46-39564 | | 11/1997 |
| JP | 3073526 | B2 | 6/2000 |
| JP | 2002-155301 | A | 5/2002 |
| JP | 2003-34803 | A | 2/2003 |
| JP | 2003-221602 | A | 8/2003 |
| JP | 3635088 | B2 | 1/2005 |

* cited by examiner

*Primary Examiner*—Roy King
*Assistant Examiner*—Ngoclan T. Mai
(74) *Attorney, Agent, or Firm*—Frishauf, Holtz, Goodman & Chick, P.C.

(57) ABSTRACT

An iron-based mixed powder for powder metallurgy having improved machinability, without degrading the mechanical property of a sintered body made by compacting the iron-based mixed power. The iron-based mixed powder comprises a mixture of an iron-based powder, a powder for an alloy, a powder for machinability improvement, and a lubricant. The powder for machinability improvement comprises a manganese sulfide powder, and at least one selected from the group consisting of a calcium phosphate powder and a hydroxy apatite powder. Alternatively the powder for machinability improvement has an average particle diameter of 1 to 60 micrometers and comprise manganese sulfide powder and calcium fluoride powder.

18 Claims, 4 Drawing Sheets

IRON-BASED MIXED POWDER FOR POWDER METALLURGY AND SINTERED BODY

TECHNICAL FIELD

This invention relates to the iron-based mixed powder for powder metallurgy, and relates to the iron-based mixed powder for powder metallurgy that enables especially the machinability improvement of a sintered body.

BACKGROUND ART

Recently, progress of powder metallurgy technology makes it possible to produce the complicated form in need of high dimensional accuracy into near-net-form. And the products that are manufactured by making use of the powder metallurgy technology becomes applicable to a variety of technological fields.

The iron-based mixed powder for powder metallurgy is produced as follows. At first, iron-based mixed powder, which is produced by mixing a powder for an alloy and a lubricant with iron-based powder, is filled up in a die cavity. Here, the powder for an alloy is one such as copper powder or graphite powder. The lubricant is one such as zinc stearate or lithium stearate. Second, they are pressurized to be formed, and subsequently they are subjected to sintering process to become a sintered body. Third, in accordance with the necessity, they are fabricated by cutting to be a final product.

Thus, the sintered body that is manufactured in such a way has a high porosity. At the moment, the sintered body has a high cutting-resistance (cutting-force), compared with metal materials produced by the melting method such as wrought steel and cast iron. For such a reason, it has conventionally been done to add a various sorts of powder such as Pb, Se, Te, Mn, S and so forth to iron-based powder, or to add such elements to the iron-based powder by alloying in an atomizing process. Such treatment has been done in order to improve the machinability of a sintered body.

However, since the melting point of Pb is as low as 330 degrees C., Pb melts in the midway of the sintering process. At the same moment, since Pb is not soluble into the ferrite, a problem happens that it is difficult to carry out uniform distribution of Pb all over a matrix. Moreover, because Se and Te embrittle the sintered body, a problem happens that degrading the mechanical property of the sintered body is significant.

As for adding the powder, in order to improve machinability, it is proposed that a variety of powders other than the above-mentioned ones are added.

As one example, addition of inorganic compound powder of high hardness to the iron-based mixed powder, as a chipping promotion material, is proposed. In this method, particles of the inorganic compound powder become a concentrating points of stress, when a part to be cut carries out plastic deformation at the time of cutting, and enforce the cut-scraps to be a small size, thereby reduce the contact surface area between a cutting tool and scraps to lower frictional resistance, and thereby prevent tool wear.

For example, in the Japanese Unexamined Patent Application Publication No. 61-147801, it is proposed to mix 0.05 to 5 mass % of manganese sulfide (MnS) powder of 10 micrometers or less in size into iron powder. Further, the Japanese Examined Patent Publication No. 46-39654 proposes a method for preparing a chipping promotion material, which means, adding $BaSO_4$ or BaS independently or in combination. And furthermore, in the Japanese Unexamined Patent Application Publication No. 2002-155301, fluorides of alkaline earth metals such as $CaF_2$, $MgF_2$, SrF, and $BaF_2$are proposed. Similarly, in the Japanese Patent No. 3073526, addition of the molten mixture of $CaF_2$ and $BaF_2$, or the combination of MnS and molten mixture of $CaF_2$ and $BaF_2$ is proposed.

Although such addition of chipping promotion material reduces the contact surface area between a cutting tool and scraps like the above and it is effective on lowering the frictional resistance, there is no function, which protects the tool surface, such as suppressing oxidization caused by frictional heat. (Here, the frictional heat generates on cutting.) And since an intermittent impact is further given to a tool at an intermittent collision between the tool and surfaces forming pores in a sintered body, there is a problem of quality-of-the-material degradation by oxidization on the surface of a tool, or a chip or fracture of the tool by generating the fine sized crack inside the tool by the intermittence impact.

As a method of preventing deterioration of the tool surface under cutting typified by oxidization, it is proposed to distribute the ceramics of the low melting point beforehand in a work material, to soften the ceramic particles exposed to the working side at the time of cutting, by the frictional heat, and to make the ceramic particles adhere and spread on the tool surface, and to make a tool protective film, what is called, an overlaying layer form. For example, Japanese Unexamined Patent Application Publication No. 9(1997)-279204 proposes such an iron-based mixed powder for powder metallurgy, which contains $CaO—Al_2O_3—SiO_2$ based compound oxide powder of 0.02 to 0.3 mass % as the ceramic powder of low melting point, which has anorthite-phase and/or gehlenite-phase, and whose average particle diameter is 50 micrometers or less, in an iron powder as main ingredient.

However, there is a problem that in some cutting conditions, generation of frictional heat between tool and a work material is insufficient, and the low fusing point ceramics does not become soft, and therefore tool protective film is not formed.

DISCLOSURE OF INVENTION

The purpose of this invention is to solve the problem of the above-mentioned conventional technology advantageously. This invention aims at offering the iron-based mixed powder for powder metallurgy, which can improve machinability, without being accompanied by degrading the mechanical property of a sintered body.

In the present invention, 'machinability' is defined as, in another word, 'easiness to be cut', at the time when cutting-work is done. Such machinability is expressed by the following factors. That is to say, cutting-resistance, durability of a tool (tool-life), degree of roughness on the finishing-surface, a figure of the cutting-scraps and so forth.

As the first embodiment in order to attain the above-mentioned subject, the inventors of the present invention did investigation wholeheartedly, while taking notice on MnS as powder for machinability improvement, concerning how co-addition of the additional powder for machinability improvement influences on the further improvement in machinability. As a result, the inventors have conceived that as the powder for machinability improvement, additional to MnS, co-addition of calcium phosphate and/or the hydroxy apatite remarkably improves machinability without being accompanied by degradation of mechanical property, compared with adding MnS independently. Although the exact mechanism of this improvement in machinability does not appear to be clear at present, these inventors esteem and conclude as follows.

As for MnS, it is said that the effect of the machinability improvement is caused by so-called a chipping effect that makes cutting-scraps a fine small size. However, the tool surface contacts a work material (the material to be cut) directly and generates heat by friction in the atmosphere, the quality of the material of a tool deteriorates by oxidization on the surface of a tool. Therefore, such a chipping effect cannot obtain a sufficient result such as remarkable reduction of tool wear, leading to a remarkable improvement of machinability.

When, additional to MnS, calcium phosphate and/or the hydroxy apatite is co-added, and distributed in a sintered body, the particles of calcium phosphate and/or hydroxy apatite which are exposed to the working-side (cut area to be worked) at the time of cutting adhere on the surface of a tool, resulting in forming a tool protective film, while MnS promotes cutting-scraps to be a fine small-sized ones. Resultantly, above mechanisms prevent or suppress deterioration of the tool surface at the time of cutting, ending up in improving a tool life notably.

As the second embodiment, the inventors of the present invention have found out that addition of manganese sulfide powder and/or calcium fluoride powder, whose average particle diameter is 1 to 60 micrometers, are effective on attaining such a purpose.

Based on the above-mentioned knowledge, this invention proceeds further examination and is evolved to be completed.

This invention is summarized as follows.

(1) An iron-based mixed powder for powder metallurgy comprising an iron-based mixed powder made by mixing an iron-based powder, a powder for an alloy, and a powder for a machinability improvement, and a lubricant;

wherein the powder for machinability improvement comprises a manganese sulfide powder, and at least one selected from the group consisting of a calcium phosphate powder and a hydroxy apatite powder, and, wherein the powder for machinability improvement comprises a manganese sulfide powder, and at least one selected from the group consisting of a calcium phosphate powder and a hydroxy apatite powder, and, wherein the powder for machinability improvement is in an amount of 0.1 to 1.0 mass % based on the total amounts of the iron-based powder, the powder for an alloy, and the powder for machinability improvement.

(2) The iron-based mixed powder for powder metallurgy according to (1), wherein the powder for machinability improvement comprises the calcium phosphate powder which is at least one selected from the group consisting of tricalcium phosphate, calcium hydrogen phosphate, and calcium dihydrogen phosphate.

(3) The iron-based mixed powder for powder metallurgy according to (1) or (2), wherein the powder for machinability improvement has an average particle diameter of 0.1 to 20 micrometers.

(4) The iron-based mixed powder for powder metallurgy according to any one of (1) to (3), which further comprises at lease one binder.

In this embodiment, it is preferable that a part or all parts of the iron-based powder has a surface onto which at least one powder selected from the group consisting of the powder for an alloy and the powder for machinability improvement adheres by a binder.

(5) An iron-based sintered body made by a process comprising compacting the iron-based mixed powder for powder metallurgy according to any one of (1) to (4), and subsequently sintering the resultant compacted iron-based mixed powder.

(6) An iron-based mixed powder for powder metallurgy comprising:

an iron-based mixed powder made by mixing an iron-based powder, a powder for an alloy, a powder for a machinability improvement and a lubricant;

wherein the powder for machinability improvement is at least one selected from the group consisting of manganese sulfide powder and calcium fluoride powder; wherein the powder for the machinability improvement has an average particle diameter of 1 to 60 micrometers; and wherein the powder for machinability improvement is in an amount of 0.1 to 1.5 mass % based on the total amounts of the iron-based powder, the powder for an alloy, and the powder for machinability improvement.

(7) The iron-based mixed powder for powder metallurgy according to (6), wherein at least one of the manganese sulfide powder and the calcium fluoride powder has a particle size distribution that is substantially the same as the size distribution of pores of a sintered body obtained by compacting the iron-based mixed powder without adding the manganese sulfide powder or the calcium fluoride powder and by sintering the resultant compacted iron-based mixed powder.

(8) The iron-based mixed powder for powder metallurgy according to (6) or (7), wherein an average particle diameter of the manganese sulfide powder is 1 to 10 micrometers and an average particle diameter of calcium fluoride powder is 20 to 60 micrometers; wherein the content of the calcium fluoride powder is 20 to 80 mass % based on the total amounts of the manganese sulfide powder and the calcium fluoride powder.

(9) The iron-based mixed powder for powder metallurgy according to any one of (6) to (8), which further comprises at lease one binder In this embodiment, it is preferable that a part or all parts of the iron-based powder has a surface onto which at least one powder selected from the group consisting of the powder for an alloy and the powder for machinability improvement adheres by a binder.

(10) An iron-based sintered body made by a process comprising compacting the iron-based mixed powder for powder metallurgy according to (8) or (9), and subsequently sintering the resultant compacted iron-based mixed powder.

PREFERABLE EMBODIMENTS

First Embodiment

Figure 1:
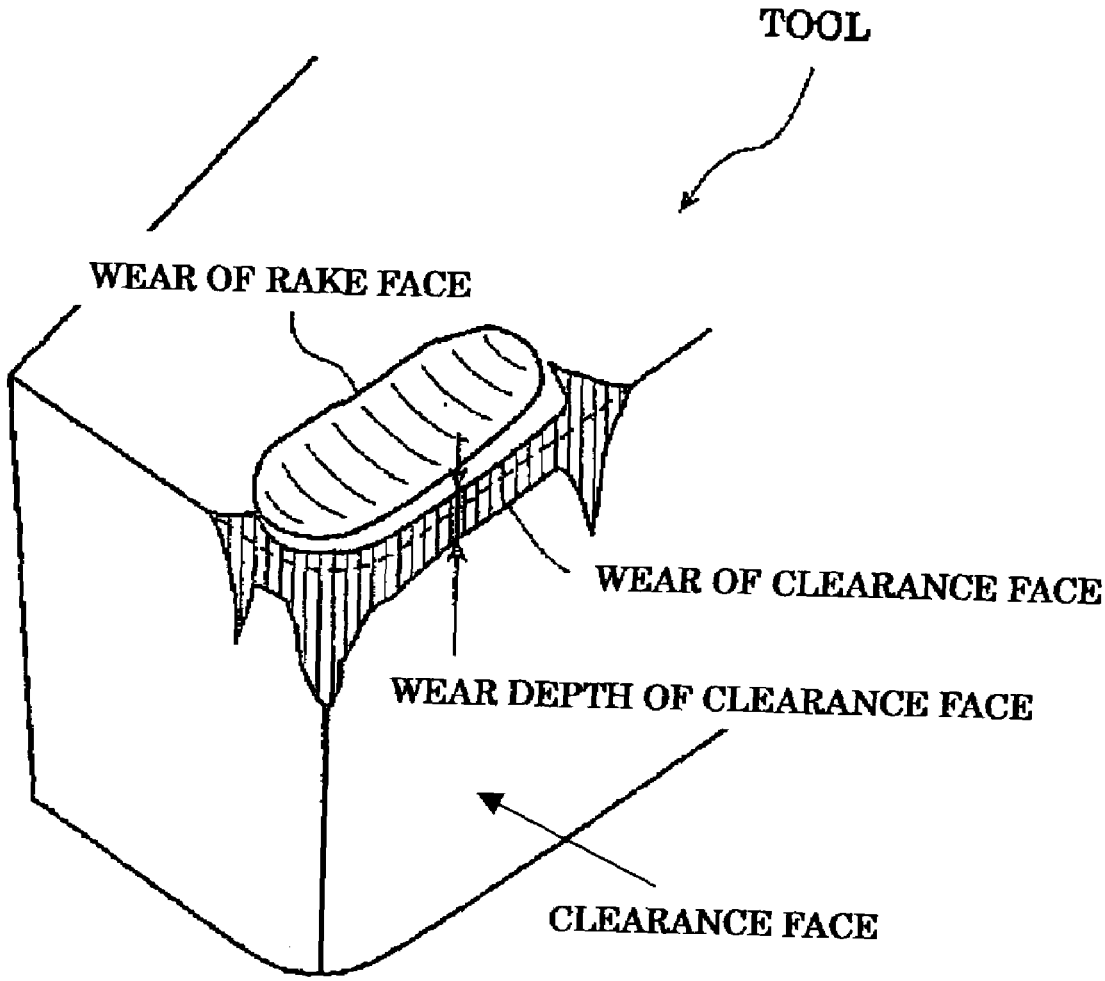
FIG. 1 is a general conceptual drawing of a wear of rake face, a flank wear of clearance face and a wear depth of clearance face, when machinability in turning using a byte is evaluated in the testing method of the present invention.

An iron-based mixed powder for powder metallurgy of this invention is an iron-based mixed powder made by mixing an iron-based powder, a powder for an alloy, a powder for machinability improvement, and a lubricant.

<Powder for Machinability Improvement>

In this invention, as a powder for machinability improvement, a manganese sulfide powder is contained. Even furthermore, a calcium phosphate powder and/or a hydroxy apatite powder are contained. In addition, it may be a case, the fluoride of alkaline-earth metals, such as calcium fluoride, is further contained.

The manganese sulfide powder for machinability improvement provides a concentrating point of stress when a sintered body is cut off. Therefore, the manganese sulfide powder enforces cutting-scraps to be a fine small size. And therefore the manganese sulfide powder reduces the contact surface area of a cutting tool and cutting-scraps, and further reduces friction-resistance that occurs on the contact surface, resulting in the function of improving machinability. As for the content of manganese sulfide, it is desirable to be fallen within a range of 10 to 80 mass %, based on the sum total amount of the powder for machinability improvement. The reason why is that the above-mentioned effect is not notable, under the condition that the content of the manganese sulfide is less than 10 mass %, based on the sum total amount of the powder for machinability improvement. On the other hand, if the content of manganese sulfide exceeds 80 mass %, the mechanical property of a sintered body degrades. Further, the amount of the component for forming tool protective film decreases, and thereby the tool-surface deteriorates, resulting in enforcing a tool-life (tool-durability) to fall down.

Although the particle diameter of the manganese sulfide powder is preferable to be selected in accordance with the usage, the average particle diameter size of 0.1 to 20 micrometers is preferable. Because, within a range of an average particle diameter of less than 0.1 micrometer, the distribution of stress concentration point gets to sparse, resulting in degrading the effect of enforcing fine small sized cutting-scraps. On the contrary, in case that an average particle diameter becomes large exceeding 20 micrometers, the compressibility of the iron-based mixed powder falls down unpreferably. More preferable minimum value of the average particle diameter is 1 micrometer. More preferable maximum value of the average particle diameter is 10 micrometers. Here, a laser diffraction-scattering method measures the particle diameter of the powder. The respective average diameters are defined as a value acquired when accumulation percent by mass is 50%.

In this invention, as the powder for machinability improvement, additional to MnS, the calcium phosphate powder and/or hydroxy apatite powder are contained further.

Calcium phosphate powder and/or hydroxy apatite powder distribute in a sintered body. And they expose to the working surface (cutting-surface) of a sintered body at the time of cutting, and calcium phosphate and a hydroxy apatite adhere to the tool surface at the time of cutting, and form a tool protective film. Deterioration of tools, such as oxidization, is prevented or suppressed by formation of a tool protective film. Resultantly, tool-durability becomes long, and machinability is improved. In addition, even in case that the sintered body contains calcium phosphate and a hydroxy apatite, very few degree of degrading in the mechanical property of a sintered body is observed, because no interaction occurs with the iron-based powder at the time of sintering. Calcium phosphate and a hydroxy apatite may be contained independently, or in combination. Addition in combination enables the corresponding effect to become more remarkable, than independent addition.

As for the average particle diameter of the additive calcium phosphate powder and/or additive hydroxy apatite powder, in the range of 0.1 to 20 micrometers is desirable, and in the range of 1 to 10 micrometers is more preferable. If the average particle diameter of calcium phosphate powder and/or hydroxy apatite powder is less than 0.1 micrometer, particles are buried in whole matrix of a sintered body. In consequence of it, a tool protective film becomes hard to be formed. On the other hand, in case that the average particle diameter exceeds 20 micrometers, it is hard to form a uniform film on the tool surface. Therefore, cutting temperature rises and oxidization of the tool surface advances. Furthermore, the softened cutting-scraps adhere to the edge of a blade. This enforces the roughness of machined surface to be coarse. It is not desirable.

As the calcium phosphate used in this embodiment, each of tricalcium phosphate ($Ca_3(PO4)_2$), calcium hydrogen phosphate ($CaHPO_4$, $CaHPO_4.2H_2O$), and calcium dihydrogen phosphate ($Ca(H_2PO_4)_2$, $Ca(H_2PO_4)_2.H_2O$) can be used preferably. In addition, from a viewpoint of the stability of a tool protective film, it is more desirable to use tricalcium phosphate ($Ca_3(PO_4)_2$) and/or calcium hydrogen phosphate ($CaHPO_4$, $CaHPO_4.2H_2O$).

A hydroxy apatite ($Ca_{10}(PO4)_6(OH)_2$) has the same function as calcium phosphate. A hydroxy apatite can be used, alone or in combination with calcium phosphate.

It may be a case that the fluoride of alkaline earth metals is further, contained, in addition to MnS powder and calcium phosphate powder and/or hydroxy apatite powder. As fluoride of alkaline earth metals, calcium fluoride, magnesium fluoride, fluoridation strontium, barium fluoride, etc. can be illustrated. As for the content of the fluoride of alkaline-earth metals, it is desirable to be fallen within the range of the sum total content of the powder for a machinability improvement, described as follows.

In the iron-based mixed powder for powder metallurgy of this invention, preferably, the powder for a machinability improvement has a content amount of 0.1 to 1.0 mass % in total based on the amount of sum totals of the iron-based powder, the powder for an alloy, and the powder for a machinability improvement. If the content of the sum total of the powder for a machinability improvement is less than 0.1 mass %, the remarkable improvement in machinability is not evident. On the other hand, in case that the content exceeds 1.0 mass %, degradation in compressibility and compressive rapture strength becomes unpreferably large. In contrast, in case that the content of the powder for a machinability improvement falls within the range of 0.1 to 1.0 mass %, the rate of a dimensional change of a sintered body also becomes small, resulting in no problem from a standing point of keeping accuracy of dimension. For this reason, the content of the powder for a machinability improvement is, in total, taken as 0.1 to 1.0 mass % based on the amount of sum totals of the iron-based powder, the powder for an alloy, and the powder for a machinability improvement. It is preferable to keep the content within 0.3 to 0.5 mass % based on the amount of sum totals of iron-based powder, the powder for an alloy, and the powder for a machinability improvement.

In addition, from a technical viewpoint of homogeneous characteristic concerning the mixed powder, the maximum particle diameter of the powder for machinability improvement is preferable to be 45 micrometers or less. It is 20 micrometers or less more preferably. Moreover, as for the average particle diameter of powder for machinability improvement, such as MnS, as described above, it is preferable to be referred to as 0.1 to 20 micrometers, or more preferably, 1 to 10 micrometers.

<Iron-Based Powder, Powder for an Alloy, and Lubricant>

As the iron-based powder, each pure iron powder, such as atomized iron powder and reduced iron powder, can be used preferably in this invention. Moreover, the following alloyed steel powder can be replaced with the iron powder. That is to say, a prealloyed steel powder that alloyed the alloying element beforehand, and a partially alloyed steel powder in which the alloying element powder was attached on the particle of pure iron powder or prealloyed steel powder beforehand. In addition, it invites no problem to mix and use the above-mentioned sorts of the iron-based powders.

As the powder for an alloy used in this invention, following ones are exemplified. These are, a graphite powder, various metallic powders such as copper powder, nickel powder, molybdenum powder and so forth. It is desirable to select the sorts of the powders appropriately and to carry out the predetermined quantity content according to the respective required product characteristics. From a viewpoint of no deteriorating the mechanical strength of a sintered body, it is preferable to limit to the range of 0.1 to 4 mass % based on the amount of the sum total of the iron-based powder, the powder for an alloy, and the powder for machinability improvement. More preferable content is 2 mass % or less, and further preferable content is 1.0 mass % or less.

As lubricant contained in the iron-based mixed powder of this invention, metal soap such as zinc stearate, lithium stearate and so forth, or wax or the like is preferable. Although the amount of the lubricant to be blended is not limited in particular by this invention, the blending amount of the lubricant is preferable to be a 0.2 to 1.5 mass part based on the amount of the sum total 100 mass part (Here, the sum total 100 mass part constitutes of iron-based powder, the powder for an alloy, and machinability improvement particle powder.). The reason why is; in case that the blending amount of the lubricant is under in 0.2 mass part, friction with a die increases, ejection force increases, and die life falls down. On the other hand, in case that blending amount of the lubricant exceeds 1.5 mass parts, green density decreases, resulting in reducing of sintered density.

<Production Method>

Below, the preferable production method of the iron-based mixed powder of this invention is explained.

As a method for producing the iron-based mixed powder, it is preferable to blend the predetermined amount of the powder for an alloy, the powder for the machinability improvement, and the lubricant, into the above-mentioned iron-based powder, and it is preferable to use usually well-known blenders, such as V shaped blender or double-cone blender. Mixing can be done at once, or in two or more steps to be an iron-based mixed powder. In order to produce the iron-based mixed powder, it may be a case, the iron-based powder is used, which has already performed segregation-preventing treatment. In this case, such treatment is done in such a way that a part or all parts of the powder for an alloy and/or a part or all parts of the powder for machinability improvement adheres to the surface of a part or all parts of the iron-based powder, utilizing a binder. Thereby, the iron-based mixed powder comes to have much less segregation, simultaneously with excelling in flowability to a great degree.

With regard to the segregation-preventing treatment, a method may be used, which is described in the Japanese Patent No. 3004800. Namely, the powder for an alloy and/or the powder for machinability improvement are mixed with the iron-based powder, while adding a particular organic matter that has the function of gluing powder particles (hereinafter simply named as 'binder'). Subsequently, it is heated up to 10 degrees C. or more, in comparison with the melting point (minimum value of the melting points of binder in case that there are two or more sorts of the binders). Preferably, it is heated up to 15 degrees C. or more. The above-mentioned heating method makes it possible to cool and solidify the binders, after at least one sort of the binders has been melted, resulting in enabling the powder for an alloy and/or the powder for machinability improvement to adhere to the surface the iron-based powder. Supplementary explaining, under the above-mentioned minimum temperature, the function for combining, which the binders have, is not exhibited.

In case that there are two or more sorts of the binders, it is more preferable that the heating temperature does not exceed the maximum value among the melting points of these binders. In case that the temperature exceeds the above-mentioned maximum temperature, there is a fear that the adhering function reduces by thermal-decomposition of the lubricant and so forth. At the same moment, there is also a fear that the discharge-performance from hopper deteriorates.

As a binder, the following ones are exemplified. These are, at least one, or two or more, selected from the group consisting of stearic acid, oleamide, stearamide, ethylenebis stearamide, and melted mixture of stearamide acid ethylenebis stearamide, which are higher fatty acids or amides thereof.

Or, this is a heat-melted mixture with the following two sorts. One is at least one, or two or more, selected from the group consisting of the oleic acid, spindle oil, and turbine oil. The other is zinc stearate.

Besides, a wax is also applicable as a binder in this invention.

In this invention, it is preferable that the content of the binder falls within a range of 0.1 to 1.0 mass part, based on the amount of the sum total 100 mass part (of iron-based powder, the powder for an alloy, and machinability improvement particle powder). Under 0.1 mass part, the segregation-preventing effect for such as powder for an alloy are not acknowledged. On the other hand, in case that the content exceeds 1.0 mass parts, the filling properties of the iron-based mixed powder reduces.

It goes without saying that the iron-based mixed powder of this invention is not limited to the one made by above-mentioned production method.

<Application>

The iron-based mixed powder of this invention may be applicable to the manufacturing-method in a general powder metallurgy. It may be a case, provides manufacturing a various parts of a machine. Concretely explaining this invention, the compaction is done by filling up (packing up) with the iron-based mixed powder to die, and by pressing. In accordance with the necessity, the corresponding sizing-treatment is done. And the corresponding sintering is done to bring about a sintered body. After such a sintering, a heat-treatment is done, these are, carburizing/quenching (hardening), bright quenching, high frequency quenching and so forth. And then, a final product such as one of machine-parts is completed. It goes without saying that some sorts of working, such as cutting-work, is treated at the respective appropriate time, resulting in obtaining the final product having a required and accurate dimension.

EXAMPLES

First Embodiment

Example 1

The following materials were prepared.

a) As an iron-based powder 100 kg, the atomized pure iron powder A (brand: JIP 301A™ (product made from JFE Steel Corp.)), the atomized pure iron powder B (brand: JIP 260A™ (product made from JFE Steel Corp.)) and, b) As a powder for an alloy, graphite powder (average particle diameter: 4 micrometers) or electrolytic cupper powder (average particle diameter 35 micrometers), c) As a powder for a machinability improvement, which has the kind, the particle diameter and the blending amount shown in Table 1.

The above-mentioned-materials a) b) c) were mixed with lubricant. Afterwards, they were charged into V shaped blender, and mixed homogeneously to be an iron-based mixed powder. The blending amount of the powder for an alloy and the powder for a machinability improvement were determined in mass %, based on the amount of the sum total of iron-based powder, the powder for an alloy, and the powder for a machinability improvement.

The applied lubricant was zinc stearate (average particle diameter: 20 micrometers), and the lubricant was determined to have the blending amount (weight part) shown in Table 1, based on the amount of sum totals 100 weight part of iron-based powder, the powder for an alloy, and the powder for a machinability improvement.

Supplementary explaining, in some of the iron-based mixed powder, the powder for machinability improvement was not blended into the mixed materials in order to demonstrate a comparative example clearly.

These iron-based mixed powder was filled into the die, and compacted by pressing, resulting in green compact (ring-shaped specimen A, B). The ring-shaped specimen A (35 mm of outer diameter×14 mm of inner diameter×10 mm in height; the dimension in conformity with radial crashing test specimen in JIS 2507) was provided for compressive rupture test and for measuring the change-rate of dimension of outer diameter. The ring-shaped specimen B (60 mm of outer diameter×20 mm of inner diameter×25 mm in height) was provided for the turning test (cutting while the specimen is turning). The green density was fixed to 6.6 $Mg/m^3$. The density was measured by the Archimedes method. (Note: Archimedes method is defined as a measurement method by using Archimedes Principle, such that solid existing in liquid receives buoyancy in terms of weight of the liquid as the same as the capacity of the solid.)

Subsequently, the green compact was sintered under the condition at 1130 degree-C. for 20 min, while using the mesh-belt type furnace in RX gas (32 vol % $H_2$-24 vol % CO-0.3 vol % $CO_2$-remainder $N_2$) atmosphere. Resultantly, the sintered body was obtained. With the obtained sintered body, the compressive radial crushing test and the turning test were performed.

The radial crushing test was performed, in accordance with the regulation of JIS Z 2507, and compressive radial crushing strength was evaluated.

The turning test is explained below. At first, three pieces of the sintered pieces of the ring-shaped specimen B were piled up to become a cylindrical shape of 75 mm in length. Next, the outside-surface of the cylindrical shape was cut, using hardmetal (HTi05T™) byte, while the cylinder was rotated around the axis of symmetry as the central axis. In order to evaluate a machinability of the sintered body, a cutting distance was evaluated. Here, the cutting distance is defined as the distance that the byte has cut until the flank wear of clearance face (i.e. wear depth of clearance face) reaches 0.5 mm.

Figure 2:
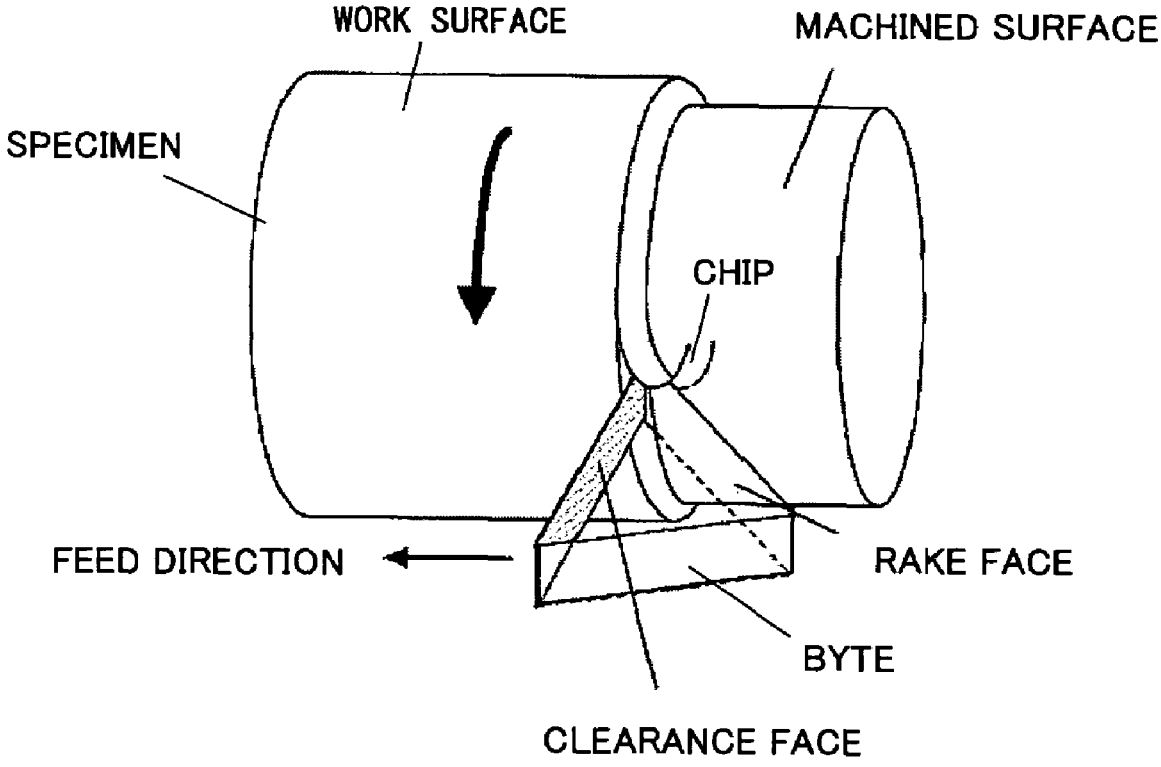
FIG. 2 is a conceptual drawing of the present invention, showing a relative relation of the respective positions about the specimen (a sintered body as a final product of the iron-based mixed powder) and a tool (cemented-carbide byte), when machinability in turning using a byte is evaluated in the testing method of the present invention.

Operational conditions for turning (cutting the ring specimen) were determined to be as follow. That is; cutting speed is 92 m/min, feed per revolution is 0.03 mm/rev, and cutting depth is 0.89 mm. Typical wearing of a clearance face is shown in FIG. 1. Also, the physical relationship of the byte and the work material (sintered body) at the time of cutting is shown in FIG. 2.

Moreover, during the turning test, the cutting work was once interrupted at the time when the cutting distance reached 4000 m. At this time, Rz, which means the surface roughness of machined surface of the specimen, was measured, based on regulation of JIS B 0601-2001 using the contact type surface roughness gauge.

The obtained result is shown in Table 1.

TABLE 1

| Iron-based mixed powder No. | Kinds of Iron-based powder | Content of Powder for an alloy (mass %)** | | Powder for machinability improvement ([—] means no adding.) | | | | | | | |
|---|---|---|---|---|---|---|---|---|---|---|---|
| | | | | MnS | | Calcium phosphate | | | Hydroxy apatite | | |
| | | Graphite powder | Copper powder | Ave. grain size (μm) | Content (mass %)** | Kinds* | Ave. grain size (μm) | Content (mass %)** | Ave. grain size (μm) | Content (mass %) | Total sum (mass %) |
| 1 | A | 0.8 | 2.0 | 20 | 0.2 | a | 5.0 | 0.6 | — | — | 0.8 |
| 2 | A | 0.8 | 2.0 | 10 | 0.1 | b | 3.6 | 0.1 | 5.4 | 0.1 | 0.3 |
| 3 | A | 0.8 | 2.0 | 4.8 | 0.1 | — | — | — | 1.3 | 0.4 | 0.5 |

TABLE 1-continued

| | | | | | | | | | | | |
|---|---|---|---|---|---|---|---|---|---|---|---|
| 4 | A | 0.8 | 2.0 | 3.5 | 0.1 | c | 1.7 | 0.05 | — | — | 0.15 |
| 5 | A | 0.8 | 2.0 | 4.8 | 0.2 | — | — | — | 3.8 | 0.1 | 0.3 |
| 6 | B | 0.9 | — | 4.8 | 0.4 | — | — | — | 1.3 | 0.1 | 0.5 |
| 7 | B | 0.9 | — | 4.8 | 0.2 | b | 3.6 | 0.3 | — | — | 0.5 |
| 8 | B | 0.7 | — | 4.8 | 0.3 | b | 1.7 | 0.2 | — | — | 0.5 |
| 9 | B | 0.7 | — | 5.3 | 0.3 | b | 3.6 | 0.2 | — | — | 0.5 |
| 10 | B | 0.7 | — | 5.1 | 0.5 | — | — | — | — | — | 0.5 |
| 11 | B | 0.7 | — | — | — | — | — | — | — | — | — |
| 12 | A | 0.8 | 2.0 | 10 | 0.4 | — | — | — | — | — | 0.4 |
| 13 | B | 0.7 | — | — | — | — | — | — | 3.8 | 0.5 | 0.5 |
| 14 | A | 0.8 | 2.0 | 25 | 0.2 | a | 5.0 | 0.6 | — | — | 0.8 |

| Iron-based mixed powder No. | Lubricant Kinds: Content (mass part)*** | Characteristics of sintered body: Radial Crushing strength MPa | Machinability: Cutting distance (m) | Machinability: Surface roughness Rz (μm) | Remarks |
|---|---|---|---|---|---|
| 1 | Zinc stearate: 0.8 | 725 | 29000 | 9.2 | Examples |
| 2 | | 728 | 28000 | 9.8 | Examples |
| 3 | | 730 | 30000 | 9.0 | Examples |
| 4 | | 725 | 27000 | 8.7 | Examples |
| 5 | | 720 | 25000 | 8.8 | Examples |
| 6 | | 610 | 30000 | 9.1 | Examples |
| 7 | | 615 | 28000 | 8.8 | Examples |
| 8 | | 611 | 24000 | 8.7 | Examples |
| 9 | | 609 | 26000 | 8.9 | Examples |
| 10 | | 614 | 10000 | 9.0 | Comparative examples |
| 11 | | 614 | 4000 | 15.3 | Comparative examples |
| 12 | | 729 | 6000 | 9.3 | Comparative examples |
| 13 | | 611 | 5000 | 9.1 | Comparative examples |
| 14 | | 750 | 12000 | 14.1 | Examples**** |

Note 1) Within a column of the signed mark * in the above-mentioned Table 1, 'a' means 'Tricalcium phosphate', 'b' means 'Calcium hydrogen phosphate, 'c' means 'Calcium dihydrogen phosphate'.
Note 2) Within a column of the signed mark ** in the above-mentioned Table 1, Content (mass %) means the content amount based on the sum total of iron-based powder, powder for an alloy and powder for machinability improvement.
Note 3) Within a column of the signed mark *** in the above-mentioned Table 1, Content amount (mass part) means that based on the sum total 100 of the mass part. The sum total is (iron-based powder + powder for an alloy + powder for machinability improvement).
Note 4) The example of the signed mark **** in the above-mentioned Table 1 is the example that the average grain size (diameter) is out of the preferable range.

In the present invention, the respective examples clearly demonstrate that the sintered body has a high compressive radial crushing strength, a long cutting distance for indicating a tool-life, and excellency in machinability. Therefore, each of these examples of this invention has excellent characteristics as iron-based mixed powder. Moreover, these examples make it possible to reduce the surface roughness Rz after cutting, resulting in reducing the burden of the further finishing-work. On the other hand, the comparative example, which spins out from the appropriate range of this invention, has low compressive radial crushing strength, or degraded machinability.

Example 2

The following materials were prepared.

a) As an iron-based powder, the atomized pure iron powder A (brand: JIP 301A™ (product made from JFE Steel Corp.)).

b) As a powder for an alloy, graphite powder (average particle diameter: 18 micrometers) or electrolytic copper powder (average particle diameter: 35 micrometers).

c) As a powder for a machinability improvement, which has the kind, the particle diameter and the blending amount shown in Table 2.

d) A binder, whose kind and the blending amount are shown in Table 2.

The above-mentioned materials, a)-d) were blended to be mixed. Afterwards, they were charged into a heating-mixer. Here, the materials were cooled, after being heated and mixed at 140 degrees C. (This temperature means a point of higher by 15 degrees C. than the minimum melting point of a binder.) And then, the mixed materials came to be an iron-based powder, in which the powder for an alloy and the powder for a machinability improvement adhered on the surface of the iron-based powder.

The blending amount of the powder for an alloy and the powder for a machinability improvement were determined in mass %, based on the amount of the sum total of iron-based powder, the powder for an alloy, and the powder for a machinability improvement. The blending amount of the binder was determined in a weight part, based on the amount of sum totals 100 weight part of iron-based powder, the powder for an alloy, and the powder for a machinability improvement.

Subsequently, lubricant was blended with the iron-based powder to which these segregation-preventing treatment had been performed. Afterwards, the material was charged into V shaped blender to be mixed homogeneously for obtaining an iron-based mixed powder. Lubricant was the kind shown in Table 2. And the blending amount (mass part) of the lubricant was shown in Table 2, based on the amount of the sum total 100 mass part of the iron-based powder, the powder for an alloy, and the powder for a machinability improvement.

The obtained iron-based mixed powder was filled into the die. The compaction was carried out, and it came to be the green compact (ring-shaped specimen A, B) like Example 1. Subsequently, like Example 1, this green compact was sintered under the conditions at 1130 degree-C. and for 20 min in RX gas atmosphere, while using the mesh-belt type furnace. Resultantly, the sintered body was obtained. About the obtained sintered body, the compressive rupture test and the turning test were carried out like Example 1.

The obtained result is shown in Table 3.

TABLE 2

| Iron-based mixed powder No. | Kinds of Iron-based powder | Content of Powder for an alloy (mass %)** | | Powder for machinability improvement ([—] means no adding.) | | | | | | |
|---|---|---|---|---|---|---|---|---|---|---|
| | | | | MnS | | Calcium phosphate | | | Hydroxy apatite | |
| | | Graphite powder | Copper powder | Ave. grain size (μm) | Content (mass %)** | Kinds* | Ave. grain size (μm) | Content (mass %)** | Ave. grain size (μm) | Content (mass %) |
| 21 | A | 0.8 | 2.0 | 4.8 | 0.2 | a | 5.0 | 0.2 | — | — |
| 22 | A | 0.8 | 2.0 | 4.8 | 0.3 | c | 1.7 | 0.1 | 3.5 | 0.1 |
| 23 | B | 0.9 | — | 4.8 | 0.1 | b | — | — | 1.3 | 0.4 |
| 24 | B | 0.9 | — | 4.8 | 0.3 | b | 3.8 | 0.2 | — | — |
| 25 | A | 0.8 | 2.0 | 4.8 | 0.5 | — | — | — | — | — |
| 26 | B | 0.9 | — | 4.8 | 0.5 | — | — | — | — | — |

| Iron-based mixed powder No. | Powder for machinability improvement (continued) Calcium fluoride | | | Binder | Segregation-preventing treatment | Lubricant | Remarks |
|---|---|---|---|---|---|---|---|
| | Ave. grain size (μm) | Content (mass %)** | Total sum (mass %) | Kinds: Blending amount (mass %)*** | Heating temperature (° C.) | Kinds: Blending amount (mass %)*** | |
| 21 | 5.0 | 0.1 | 0.5 | Zinc stearate: 0.35 Oleic acid: 0.1 | 140 | Zinc stearate: 0.4 | Example |
| 22 | — | — | 0.5 | Zinc stearate: 0.35 Oleic acid: 0.1 | 140 | Zinc stearate: 0.4 | Example |
| 23 | — | — | 0.5 | Mono-stearamide: 0.2 Bisstearamide: 0.2 | 140 | Zinc stearate: 0.16 Bisstearamide: 0.24 | Example |
| 24 | — | — | 0.5 | Mono-stearamide: 0.2 Bisstearamide: 0.2 | 140 | Zinc stearate: 0.1 Bisstearamide: 0.3 | Example |
| 25 | — | — | 0.5 | Zinc stearate: 0.35 Oleic acid: 0.1 | 140 | Zinc stearate: 0.4 | Comparative example |
| 26 | — | — | 0.5 | Mono-stearamide: 0.2 Bisstearamide: 0.2 | 140 | Zinc stearate: 0.1 Bisstearamide: 0.3 | Comparative example |

Note 1) Within a column of the signed mark * in the above-mentioned Table 2, 'a' means 'Tricalcium phosphate', 'b' means 'Calcium hydrogen phosphate, 'c' means 'Calcium dihydrogen phosphate'.
Note 2) Within a column of the signed mark ** in the above-mentioned Table 2, Content (mass %) means the content amount based on the sum total of iron-based powder, powder for an alloy and powder for machinability improvement.
Note 3) Within a column of the signed mark *** in the above-mentioned Table 2, Content amount (mass part) means that based on the sum total 100 of the mass part. The sum total is (iron-based powder + powder for an alloy + powder for machinability improvement).

TABLE 3

| Iron-based mixed powder No. | Characteristics of sintered body: Radial crushing strength (MPa) | Machinability: Cutting distance (m) | Machinability: Surface roughness Rz (μm) | Remarks |
|---|---|---|---|---|
| 21 | 730 | 28000 | 9.0 | Examples |
| 22 | 727 | 27000 | 8.9 | Examples |
| 23 | 625 | 25000 | 9.3 | Examples |
| 24 | 623 | 28000 | 9.2 | Examples |
| 25 | 725 | 6000 | 13.8 | Comparative examples |
| 26 | 630 | 8000 | 15.2 | Comparative examples |

Like Example 1, the whole of these examples of the present invention has the high compressive rapture strength of a sintered body. The cutting distance for judging the tool-life (durability) is long. Such an examples serves as a sintered body excellent in machinability. Therefore, the iron-based mixed powder has the characteristic, which is excellent as iron-based mixed powder.

As explained up to now, the present invention makes it possible for the sintered body to be improved about machinability. This improvement is done without degrading the mechanical properties of the sintered body. Such improvement enables the productivity of the sintered body, which requires the cutting-work, to become higher remarkably, resulting in a brilliant industrial effect to a great extent.

Second Embodiment

The 2nd embodiment comprises an iron-based mixed powder, by mixing iron-based powder, the powder for an alloy, the powder for machinability improvement, and lubricant. The powder for machinability improvement comprises manganese sulfide powder and/or calcium fluoride powder, whose average particle diameter is 1 to 60 micrometers, and whose content is 0.1 to 1.5 mass % in total based on the amount of sum totals of iron-based powder, the powder for an alloy, and the powder for machinability improvement.

Moreover, in this embodiment, it is desirable that it is characterized that the particle size distribution of the powder, which consists of at least one sort of manganese sulfide powder and calcium fluoride powder, is substantially the same as the size distribution of pores of a sintered body, obtained by compacting the iron-based mixed powder without adding manganese sulfide powder or calcium fluoride powder and by sintering the formed iron-based mixed powder.

Furthermore, in this invention,

In order to obtain green density of a certain domain (as described later), following condition is desirable. The average particle diameter of manganese sulfide is 1 to 10 micrometers, and the average particle diameter of calcium fluoride is 20 to 60 micrometers. And the content of calcium fluoride is 20 to 80 mass % based on the amount of sum totals of manganese sulfide and calcium fluoride. By sintering such green compact, the sintered body whose machinability is very good can be obtained.

<Powder for Machinability Improvement>

This embodiment has the feature in average particle diameter using manganese sulfide powder and/or calcium fluoride powder, which are 1 to 60 micrometers as powder for machinability improvement.

The machinability improvement effect of manganese sulfide powder and calcium fluoride powder is provided by the chipping effect as above-mentioned, i.e. making scraps a fine size. However, since an intermittent impact was given to a tool by pores, which exists in a sintered body, there was a problem of the oxidization on the surface of a tool or quality-of-the-material degradation by generating of fine cracks inside the tool by an intermittence impact.

When the particle size distribution of the powder, which consists of at least one sort of manganese sulfide powder and calcium fluoride powder, has a similarity or a resemblance to (or more preferably, is substantially the same as) the size distribution of pores of a sintered body obtained by compacting and sintering without adding manganese sulfide powder or calcium fluoride powder. The particles of manganese sulfide powder and/or calcium fluoride powder efficiently fill up with pores in the sintered body, which is created during compaction and sintering, resulting in decreasing pores. So, the intermittence impact given to a tool by the collision with the free surface, which form pores inside a sintered body, and tool can be eased. Consequently, it can suppress wear on the surface of a tool, or generation of the fine small sized crack inside a tool, bringing about an extent ion of a tool life. Especially, in this invention, a great impact can be reduced by filling up with a coarse pore that is over 30 micrometers.

To accomplish the relationship between the particle size distribution of the powder and the pore size distribution of the sintered body as discussed in the preceding paragraph, for example, the following procedure is exemplified. The manganese sulfide powder and/or calcium fluoride powder is classified by mesh using ordinary sieving method. On the other hand, the sintered body of an iron-based mixed powder without any additive for the machinability improvement (such as the manganese sulfide powder or the calcium fluoride powder) is prepared by compacting and sintering in an appointed condition (i.e. equivalent to the predetermined condition for inventive mixed powder). A section of the sintered body observed by an optical microscope is photographed. This image is taken in a computer, and a size for an area of the pore section can be defined as a diameter of the circle having the same area as the pore. The pore size distribution, which is an original pore size distribution in the sintered body without any additive for the machinability improvement, is represented by the existence ratio of the number of pores in the aforesaid each mesh section to a total number of pores in the image. Then, the classified powders of manganese sulfide powder and/or calcium fluoride powder are blended by approximately the same ratio with the existence ratio (of the original pore size distribution) for each mesh section.

Needless to say, it is preferable that the average particle diameter of manganese sulfide powder and/or calcium fluoride powder is substantially the same (or substantially equivalent) as the original pore size distribution. Note, however, it is not necessary that the particle size distribution of the aforesaid powder and the pore size distribution of the aforesaid compact be identical. Rather, a rough similarity (or resemblance) between the particle size distribution of the aforesaid powder and the pore size distribution of the aforesaid compact would have a sufficient effect. In other words, any process that improves similarity between the two distributions (i.e. bring the two distributions closer to substantially the same) enhances the machinability improvement effect. Therefore, in the above example method, the differences in the existence ratio in the mesh section is acceptable even for about 20% of the ratio or about 10 point in percentage. Same is applied for following simpler method.

Further, for example, the following procedure is conceivable as a simpler way, in the case that the average particle diameter of manganese sulfide powder differs from that of calcium fluoride powder. The aforesaid original pore size distribution is estimated by the existence ratio of two groups. Here, the two groups are defined so that each of the two average particle diameters (of the manganese sulfide powder and the calcium fluoride powder) to be the representing value of each one of the groups. For example the two groups are divided by the arithmetic mean value or the logarithm mean value of the two average particle diameters. Then, the manganese sulfide powder and the calcium fluoride powder are blended such that the ratio of them being approximately the same, or at least getting closer to the existence ratio (of the original pore size distribution).

As for the component having the density of 6.0 to 7.0 $Mg/m^3$, which is the density of general-purpose iron-based sintered component, it is preferable to meet the following condition as a more simplified method for improving the aforesaid similarity. An average particle diameter of manganese sulfide powder is 1 to 10 micrometers. And that of calcium fluoride powder is 20 to 60 micrometers. And further, the content of calcium fluoride is 20 to 80 mass % based on the amount of sum totals of manganese sulfide powder and calcium fluoride powder. By satisfying the condition, manganese sulfide particles and calcium fluoride particles fill up with pores inside the sintered body and it eases an intermittence impact effectively, while promoting chipping of the scraps during cutting the component.

In this embodiment, a laser diffraction-scattering method using laser measures the particle diameter of the powder. The average particle diameter was defined by 50%-accumulation transmission particle diameter ($d_{50}$) by mass. Moreover, the original pore size distribution is evaluated by the following procedure. Optical-microscope photograph of cross section of sintered body, which is practically produced without any additives for machinability improving, is converted into electronic image by a scanner. Then, the brightness of the image is binarized into a clear part and a dark part. Then, the dark part is considered to be the pore, and the area (cross section) thereof is estimated by the number of pixels. Each pore size is defined as a diameter of the circle having the same area as the pore, and then, the existence ration by number for each size is evaluated.

In order to effectively utilize the chipping effect and the effect of reducing intermittence impact, it is desirable that the powder for machinability improvement is in an amount of 0.1 to 1.5 mass % based on the total amounts of the iron-based powder, the powder for an alloy, and the powder for machinability improvement.

<Other Ingredients, Production Method, and Application>

Other suitable ingredients, suitable production method, and suitable application applied in this invention are entirely the same with that described in the terms titled <Iron-based powder, powder for an alloy, and lubricant>, <Production method>, and <Application> in (First embodiment), and therefore, incorporated by reference, in the condition that no obvious contradiction exists.

Example 3

The following materials were prepared.

a) As an iron-based powder 100 kg, the atomized pure iron powder A (brand: JIP 260A™ (product made from JFE Steel Corp.)),
b) As a powder for an alloy, graphite powder (average particle diameter of 4 micrometers). The amount of the graphite powder is 0.7 mass % based on the amount of sum totals of iron-based powder, the powder for an alloy, and the powder for machinability improvement,
c) As a powder for a machinability improvement, manganese sulfide powder and/or calcium fluoride powder of average particle diameters and predetermined blending amounts (mass %) which are shown in Table 4.
d) As a lubricant, zinc stearate (average particle diameter: 20 micrometers) as a lubricant, are mixed, whose amount is 0.8 mass % based on the amount of sum totals 100 mass % of iron-based powder, the powder for an alloy, and the powder for machinability improvement.

The above-mentioned-materials a) to d) were mixed and then, the iron-based mixed powder was produced.

In addition, iron-based mixed powders as comparative examples are prepared, in which a calcium phosphate powder or a hydroxy apatite powder was blended, or, no powders for machinability improvement were contained.

These iron-based mixed powder was filled into the die, and compacted by pressing, resulting in green compact of the dimensions of A: 35 mm of outer diameter×14 mm of inner diameter×10 mm in height; the dimension in conformity with radial crashing test specimen in JIS 2507, and, C: 60 mm of outer diameter×10 mm in height; tablet-shaped specimen for drill cutting test. The green density was fixed to 6.6 $Mg/m^2$.

Subsequently, the specimen green compact was sintered under the condition at 1150 degree-C. and for 20 min, while using the mesh-belt type furnace in a gas of 5 vol % $H_2$-remainder $N_2$. Resultantly, the sintered body of sintered density of 6.5 to 6.7 $Mg/m^3$ was obtained. With the obtained sintered body (specimen), the radial crushing test in accordance with the regulation of JIS Z 2507 and the cutting test were performed.

Figure 3:
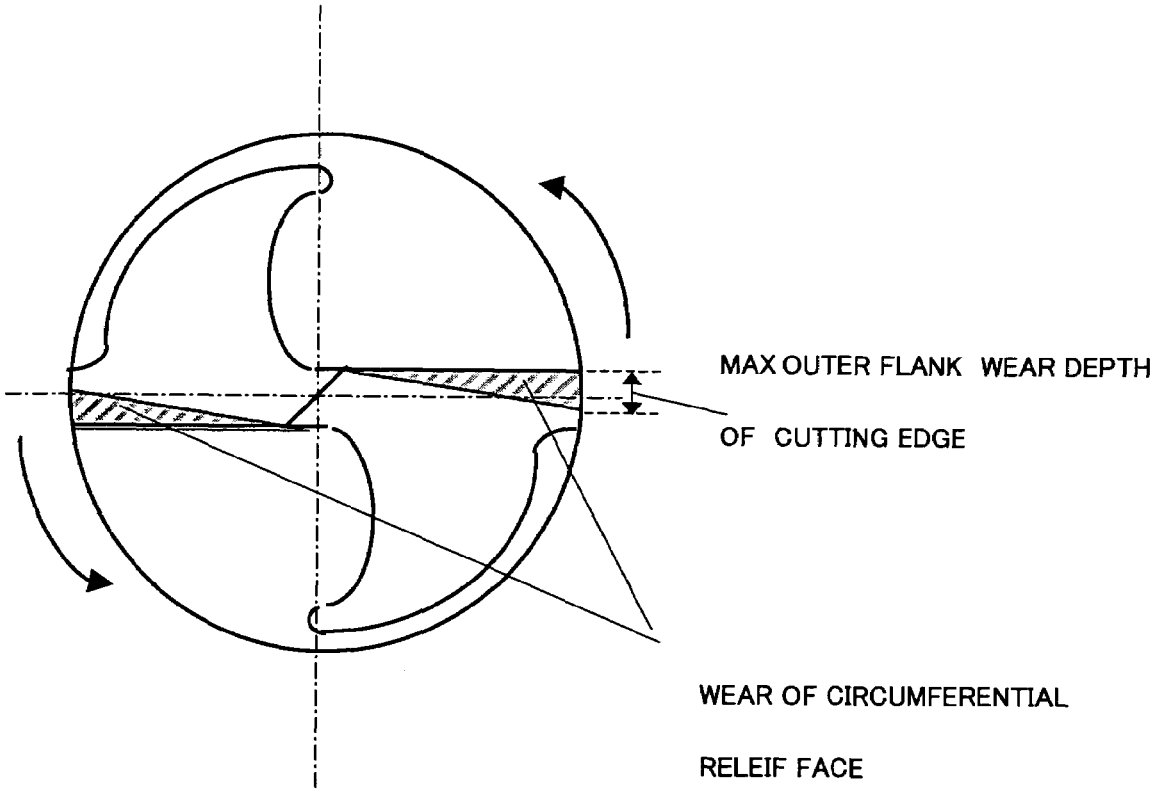
FIG. 3 is a conceptual drawing of the present invention, showing a wear of circumferential relief surface and a maximum outer flank wear depth of cutting edge, when machinability is evaluated in the testing method of the present invention, when using a drill.

Drill cutting test was done, using a drill of outer diameter: 3.0 mm hardmetal (HTi05T™). Drill cutting of the plane of the tablet-shaped sintered body was carried out on condition of rotational speed: 800 rpm and 0.02 mm/rev. Torque and amplitude of the vibration of torque were measured at the time of 200th hole working, as cutting force. Further, the (maximum) outer flank wear depth of the drill after 200 hole working was measured and compared. The appearance of wear of a drill circumferential part is shown in FIG. 3.

Figure 4:
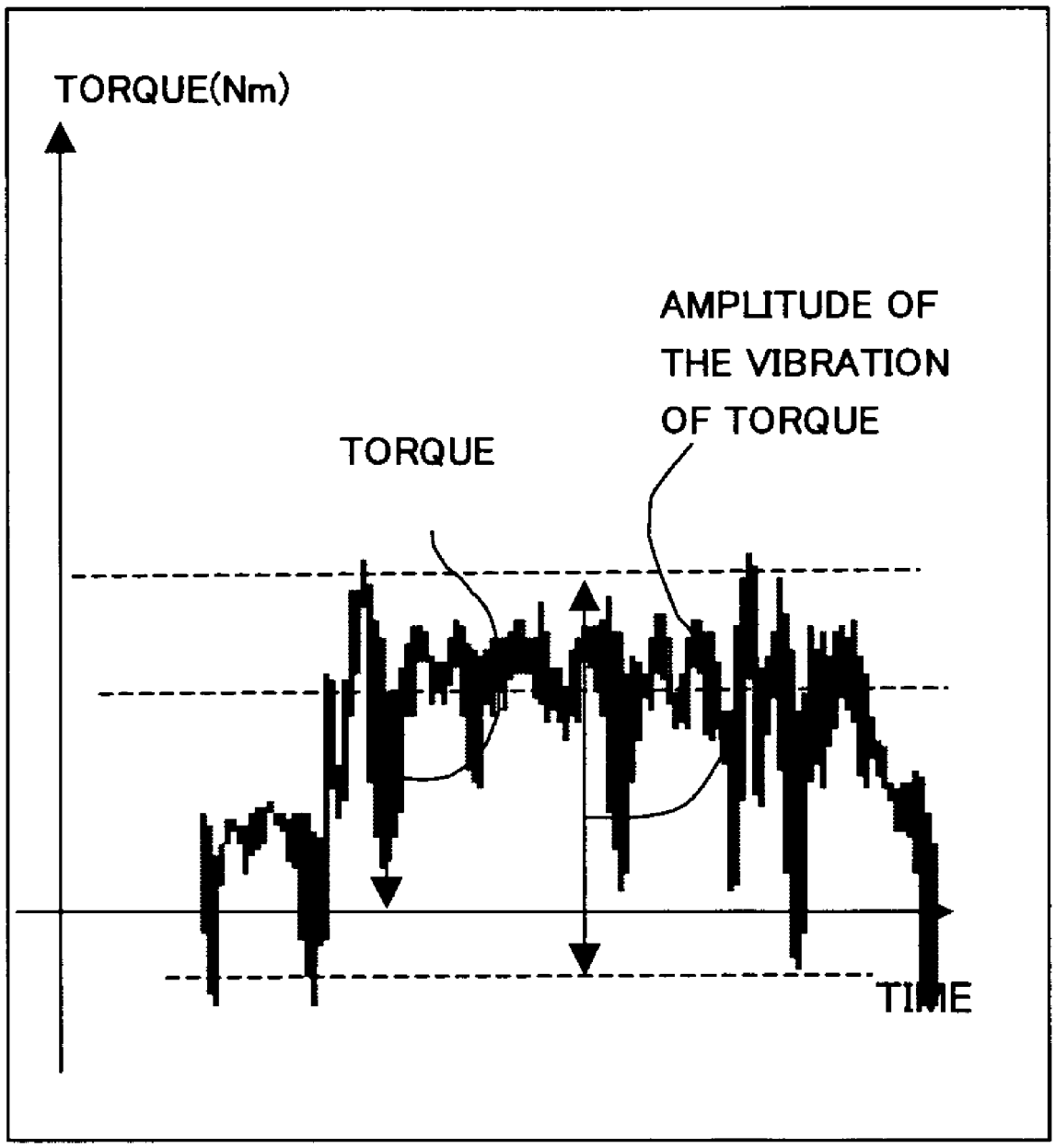
FIG. 4 shows torque and amplitude of the vibration of torque, on a chart of the torque on the time-passage, when machinability is evaluated in the testing method of the present invention, when using a drill.

As for torque and its amplitude of the vibration, a work material was set to a tool dynamometer (a product of Kistler Japan Co. Ltd.). Here, while drill cutting work is done, the change of the torque was measured, when the time passed. FIG. 4 shows the change of the torque on the time-passage. The torque was estimated based on the average value of the height of rectangular wave. Based on the amplitude of the vibration on a rectangular wave, the variation of the torque was estimated.

The above test result is shown in Table 4.

TABLE 4

| Iron-based mixed powder (ID) | Powder formachinability improvement (additive amount (mass %))*/ Average grain diameter | | | | Characteristics of sintered body | | | | |
|---|---|---|---|---|---|---|---|---|---|
| | MnS/ 4.97 μm | Calcium hydrogen phosphate/ 3.81 μm | Hydroxy apatite/ 3.57 μm | $CaF_2$/ 33.90 μm | Radial crushing strength (MPa) | Hardness HRB | Max. outer flank wear depth of cutting edge (per 200 Holes) (m | Torque (Nm) (200th Hole) | Amplitude of the vibration of torque (Nm) (200th Hole) |
| Example1 | 0.5 | — | — | 0.2 | 445 | 37 | 0.035 | 0.07 | 0.07 |
| Example2 | 0.35 | — | — | 0.35 | 453 | 34 | 0.038 | 0.07 | 0.06 |
| Example3 | 0.2 | — | — | 0.5 | 490 | 43 | 0.053 | 0.06 | 0.07 |
| Comparative example 1 | — | — | — | — | 471 | 35 | 0.155 | 0.24 | 0.13 |
| Comparative example 2 | 0.7 | — | — | — | 455 | 34 | 0.041 | 0.11 | 0.12 |
| Comparative example 3 | — | 0.7 | — | — | 460 | 34 | 0.100 | 0.20 | 0.15 |
| Comparative example 4 | — | — | 0.7 | — | 476 | 37 | 0.095 | 0.12 | 0.12 |
| Comparative example 5 | — | — | — | 0.7 | 455 | 31 | 0.076 | 0.11 | 0.10 |

Note 1) Within a column of the signed mark * in the above-mentioned Table 4, Content (mass %) means the content amount based on the sum total of iron-based powder, powder for alloy and powder for machinability improvement.
[—]means no adding.

The present invention brings about very little degradation of the strength of the sintered body. The outer flank wear of the drill is very few, which means, equal or less than 0.05 mm. Furthermore, the cutting power (torque) and the amplitude of the vibration thereof are very small. The amplitude of the vibration of the cutting force corresponds to the intermittence impact. In the present invention, pores inside a sintered body are effectively reduced, resulting in reducing intermittence impact. On the other hand, the comparative example (or the conventional example), which falls out of the range of the example of the present invention, show that the tool wear, the cutting power and the amplitude of the vibration of the cutting power increase to a great extent, resulting in a lot of difficulty to be cut.

As mentioned above, this embodiment, as well as present invention, makes it possible for the sintered body to be improved about machinability. This improvement is done without degrading the mechanical properties of the sintered body. Such improvement enables the productivity of the sintered body, which requires the cutting-work, and tool-life, to become higher remarkably, resulting in a brilliant industrial effect to a great extent.

What is claimed is:

1. An iron-based mixed powder for powder metallurgy comprising an iron-based mixed powder made by mixing an iron-based powder, a powder for an alloy, a powder for machinability improvement and a lubricant;

wherein the powder for machinability improvement comprises a manganese sulfide powder, and at least one selected from the group consisting of a calcium phosphate powder and a hydroxy apatite powder, and, wherein the powder for machinability improvement is in an amount of 0.1 to 1.0 mass % based on the total amounts of the iron-based powder, the powder for an alloy, and the powder for machinability improvement.

2. The iron-based mixed powder for powder metallurgy according to claim 1, wherein the powder for machinability improvement comprises the calcium phosphate powder which is at least one selected from the group consisting of tricalcium phosphate, calcium hydrogen phosphate and calcium dihydrogen phosphate.

3. The iron-based mixed powder for powder metallurgy according to claim 1, wherein the powder for machinability improvement has an average particle diameter of 0.1 to 20 micrometers.

4. The iron-based mixed powder for powder metallurgy according to claim 2, wherein the powder for machinability improvement has an average particle diameter of 0.1 to 20 micrometers.

5. The iron-based mixed powder for powder metallurgy according to any one of claims 1 to 4, which further comprises at least one binder.

6. The iron-based mixed powder for powder metallurgy according to any one of claims 1 to 4, wherein each of the manganese sulfide powder and the calcium phosphate powder and/or the hydroxy apatite powder has an average particle diameter of 0.1 to 20 micrometers; and the powder for machinability improvement contains the manganese sulfide powder in an amount of 10 to 80 mass % based on the total amount of the powder for machinability improvement.

7. The iron-based mixed powder for powder metallurgy according to claim 1, wherein the iron-based powder is at least one powder selected from the group consisting of an atomized iron powder, a reduced iron powder, a prealloyed steel powder and a partially alloyed steel powder; and wherein the powder for an alloy is at least one powder selected from the group consisting of a graphite powder, a copper powder, a nickel powder and a molybdenum powder.

8. An iron-based sintered body made by a process comprising compacting the iron-based mixed powder for powder metallurgy according to any one of claims 1 to 4, and subsequently sintering the resultant compacted iron-based mixed powder.

9. An iron-based mixed powder for powder metallurgy comprising:

an iron-based mixed powder made by mixing an iron-based powder, a powder for an alloy, a powder for a machinability improvement and a lubricant;

wherein the powder for machinability improvement comprises manganese sulfide powder and calcium fluoride powder;

wherein the powder for the machinability improvement has an average particle diameter of 1 to 60 micrometers;

wherein the powder for machinability improvement is in an amount of 0.1 to 1.5 mass % based on the total amounts of the iron-based powder, the powder for an alloy, and the powder for machinability improvement;

wherein an average particle diameter of the manganese sulfide powder is 1 to 10 micrometers and an average particle diameter of the calcium fluoride powder is 20 to 60 micrometers; and wherein the content of the calcium fluoride powder is in an amount of 20 to 80 mass % based on the total amounts of the manganese sulfide powder and the calcium fluoride powder.

10. The iron-based mixed powder for powder metallurgy according to claim 9, wherein the manganese sulfide powder and the calcium fluoride powder has a particle size distribution that is substantially the same as the size distribution of pores of a sintered body obtained by compacting the iron-based mixed powder without adding the manganese sulfide powder or the calcium fluoride powder and by sintering the resultant compacted iron-based mixed powder.

11. The iron-based mixed powder for powder metallurgy according to claim 9 or 10, which further comprises at least one binder.

12. The iron-based mixed powder for powder metallurgy according to claim 9 or 10, wherein the iron-based powder is at least one powder selected from the group consisting of an atomized iron powder, a reduced iron powder, a prealloyed steel powder and a partially alloyed steel powder; and wherein the powder for an alloy is at least one powder selected from the group consisting of a graphite powder, a copper powder, a nickel powder and a molybdenum powder.

13. An iron-based sintered body made by a process comprising compacting the iron-based mixed powder for powder metallurgy according to claim 11, and subsequently sintering the resultant compacted iron-based mixed powder.

14. An iron-based sintered body made by a process comprising compacting the iron-based mixed powder for powder metallurgy according to claim 10, and subsequently sintering the resultant compacted iron-based mixed powder.

15. The iron-based mixed powder for powder metallurgy according to claim 1, wherein the magnesium sulfide powder has an average particle diameter of 1 to 10 micrometers; and at least one of the calcium phosphate and the hydroxy apatite powder has as an average particle diameter of 1 to 10 micrometers; the powder for machinability improvement comprises a calcium phosphate powder selected from the group consisting of tricalcium phosphate, calcium hydrogen phosphate and calcium dihydrogen phosphate.

16. The iron-based mixed powder according to claim 1, wherein the powder for machinability improvement is in an amount of 0.3 to 0.5 mass % based on the total amount of the iron-based powder, the powder for an alloy and the powder for machinability improvement.

17. The iron-based mixed powder according to claim 1, wherein the powder for an alloy is in an amount of 0.1 to 4 mass % based on one total amount of the iron-based alloy, the powder for an alloy and the powder for machinability improvement.

18. The iron-based mixed powder according to claim 9, wherein the powder for an alloy is an amount of 0.1 to 4 mass % based on one total amount of the iron-based alloy, the powder for an alloy and the powder for machinability improvement.

* * * * *